US007736126B2

(12) United States Patent
Joco et al.

(10) Patent No.: US 7,736,126 B2
(45) Date of Patent: Jun. 15, 2010

(54) WIDE FLOW COMPRESSOR WITH DIFFUSER BYPASS

(75) Inventors: Fidel M. Joco, Long Beach, CA (US); Frank F. Lin, Torrance, CA (US); Dave Elpern, Los Angeles, CA (US)

(73) Assignee: Honeywell International Inc., Morristown, NJ (US)

( * ) Notice: Subject to any disclaimer, the term of this patent is extended or adjusted under 35 U.S.C. 154(b) by 681 days.

(21) Appl. No.: 11/560,676

(22) Filed: Nov. 16, 2006

(65) Prior Publication Data

US 2008/0118341 A1 May 22, 2008

(51) Int. Cl.
*F01D 17/08* (2006.01)

(52) U.S. Cl. ..... 415/144; 415/56.4

(58) Field of Classification Search ..... 415/56.4, 415/56.5, 58.2, 144, 145, 146
See application file for complete search history.

(56) References Cited

U.S. PATENT DOCUMENTS 4,164,845 A 8/1979 Exley et al.
4,487,548 A * 12/1984 Leachman et al. ..... 415/28
4,658,586 A 4/1987 Iwasa
6,470,864 B2 10/2002 Kim et al.
6,546,736 B2 4/2003 Rakhmailov
2006/0005526 A1 1/2006 Tanaka et al.

FOREIGN PATENT DOCUMENTS

JP 59-47159 11/1984
JP 09119396 A * 5/1997

OTHER PUBLICATIONS

Machine Translation of JP 09119396 A from JPO website.*

* cited by examiner

*Primary Examiner*—Edward Look
*Assistant Examiner*—Dwayne J White
(74) *Attorney, Agent, or Firm*—Oral Caglar, Esq.

(57) ABSTRACT

A centrifugal compressor is modified by forming a bypass between the leading edge of the compressor diffuser and a point downstream from the throat of the diffuser. The bypass may be unidirectional or bi-directional. In a bi-directional embodiment, an operable flow range of the compressor can be widened in both directions of a compressor map, i.e., extending both the surge and choke margins of a compressor at the expense of normal operating efficiencies. In a unidirectional bypass embodiment the flow range may be increased only in one direction, but there is no diminishment of efficiency of the compressor at normal operating conditions. The modification provides a simple expedient for increasing flow range without a need to redesign a compressor.

9 Claims, 7 Drawing Sheets

WIDE FLOW COMPRESSOR WITH DIFFUSER BYPASS

BACKGROUND OF THE INVENTION

The present invention is in the field of turbomachinery and, more particularly, centrifugal compressors.

In the field of turbomachinery, some compressor applications such as automotive turbochargers and aircraft air conditioning systems require wide stable operating flow range. Flow range in centrifugal compressors is bounded by surge conditions and choke conditions. Surge conditions develop when volume flow is too low and a discharge process is interrupted. Under surge conditions undesirable cyclical flow instability develops. Choke conditions develop when gas flow at some point in the compressor reaches sonic velocity. Under choke conditions, decreasing compressor outlet pressure does not produce increased mass flow for a given speed and inlet conditions. Thus, mass flow through a compressor is bounded by a minimum associated with surge conditions and a maximum associated with choke conditions.

Many interrelated design parameters may be used to produce a design for a compressor with desired properties. Often such designs are produced through computer generated simulations. However, as is often the case with designs having interrelated parameters, changing one design variable may adversely affect some other aspect of a compressor. Thus a compressor design for a particular application typically requires expensive iterative design trials and modeling.

After an optimized design is complete for a particular application it may be desirable to extend that design for other wider-flow range applications. Obviously, it would be advantageous to provide for a simple widening of flow range without performing a re-design. Consequently, compressor designers often seek expedients for widening a flow range of a compressor without incurring the expense of redesigning the compressor One of the most frequently used methods to widen this flow range is to add slots or ports to a stationary shroud near a leading edge of a compressor wheel. When the compressor operates at "near surge" conditions, the ports are expected to recycle gas flow from the shroud to a compressor inlet and thus reduce the potential for surging at low flowrates. When the compressor operates at "near choke" conditions, the ports are expected to suck the flow from the compressor inlet to the shroud and thus allow increased mass flow before choke conditions develop. This ported shroud concept works well for compressors with vaneless diffusers because compressor rotating stall, which induces surging, often occurs first on the inducer, the axial portion of a wheel upstream from a diffuser. Similarly, choke conditions typically develop on the wheel in compressors with vaneless diffusers.

However, many compressor applications require a vaned diffuser because such a compressor is more efficient than one with a vaneless diffuser. In compressors with vaned diffusers, the flow instability and choke could occur first inside the diffuser (i.e., downstream of the wheel). Using a ported shroud to recycle the flow near the leading edge of a wheel of a compressor with a vaned diffuser may not improve its flow range. To the contrary, a ported shroud may actually diminish the compressor's performance.

An example of a prior art compressor with a vaned diffuser is shown in FIG. 1. In FIG. 1 there is shown a partial cross-sectional view of a compressor designated generally by the numeral 10. The compressor may comprise a wheel 12, a diffuser 14 and a housing 18. In operation, the wheel 12 may rotate and draw a gas such as air into a shroud 20. The gas may flow in a downstream direction designated by mainstream flow lines 22. As the gas passes along the wheel 12, its absolute velocity increases. The gas then traverses across the diffuser 14 where its velocity decreases and its pressure increases. The gas then passes into the housing 18 for collection.

The diffuser 14 illustrated in the compressor 10 of FIG. 1 may be provided with vanes 14*a*. In that regard the diffuser 14 may be referred to as a vaned diffuser. In a typical one of the compressors 10 with one of the vaned diffusers 14, a throat 24 may develop at a region of the compressor 10 between a trailing edge 12*a* of the wheel 12 and trailing edge 14*c* of the vanes 14*a* of the diffuser 14. The throat 24 is a region of the compressor 10 with the least flow area in which gas flow may initially reach sonic velocity. In that context, the throat may be a region of the compressor 10 in which a "choke" condition may develop. Additionally, the throat 24 is a region in which "near choke" conditions may occur.

The compressor 10 may increase the mass of gas flow across the wheel 12 as the compressor outlet pressure decreases for a given wheel rotational speed and inlet conditions. As the mass flow increases, there may be a corresponding increase in velocity of gas flow inside the compressor. When this velocity reaches Mach 1 or sonic speed, further reducing the compressor outlet pressure by opening the outlet throttle may produce no additional mass of gas flow. This phenomenon is referred to as "choke". In a typical one of the compressors 10, the region with the least flow area of the compressor 10 at which "choke" or "near choke" conditions develop may be referred to as the throat 24.

The throat 24 may also be a region of the compressor 10 in which "surge" or "near surge" conditions initially develop. The phenomenon of "surge" may occur when the flow rate is so low that instability develops in the gas flow emerging from the wheel 12 or the diffuser 14. The phenomenon may produce cyclical surging of gas through the compressor 10 accompanied with harmful vibrational stresses For any particular one of the compressors 10, there may be a range of mass flows that may be produced by the compressor 10. The range is bounded by the mass flow that produces choke and the mass flow that produces surge. This range is commonly referred to as "flow range".

There has been no recognition in the prior art of a simple expedient to widen the flow range of a vaned-diffuser compressor such as the prior-art compressor 10. Typically, redesign of vaned-diffuser compressors has been required to achieve a widened flow range. As can be seen, a flow range widening expedient similar to the ported shroud of a vaneless-diffuser compressor would be desirable.

SUMMARY OF THE INVENTION

In one aspect of the present invention a compressor, comprises a wheel and a vaned diffuser is provided with a bypass with an inlet positioned upstream and near the throat of the compressor.

In another aspect of the present invention a method for compressing a widened flow range of gas with a compressor comprises the steps of driving a mass of the gas with a wheel, directing a first portion of the mass of gas through a throat of the compressor, which throat is downstream from the wheel, and flowing a second portion of the mass of gas around the throat.

In a still another aspect of the present invention, a compressor having a throat that is downstream from a trailing edge of a wheel comprises a bypass with an upstream inlet positioned upstream near the throat and a downstream inlet positioned downstream of the throat.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention may be useful in widening a flow range of a centrifugal compressor without affecting its performance characteristics during its most frequent normal operating conditions. More particularly, the present invention may provide a simple expedient that can be applied to a compressor of a particular design to widen the flow range of that compressor.

In contrast to prior art compressors, among other things, the present invention may provide a bypass in a compressor which may allow a portion of a flow of gas through the compressor to bypass a point in the compressor at which choke and surge conditions develop.

Figure 1:
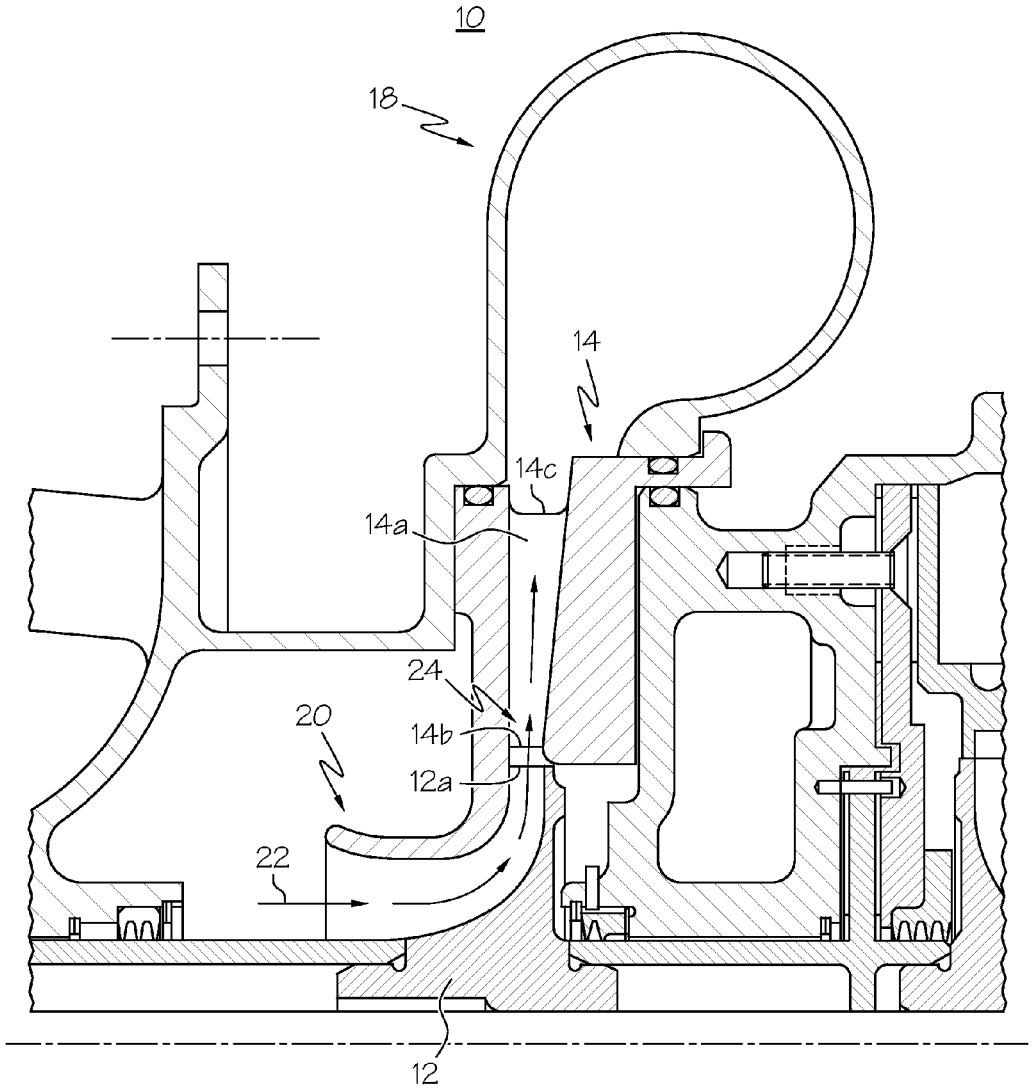
FIG. 1 (Prior Art)
FIG. 1 is partial cross sectional view of a compressor in accordance with the prior art.

The present invention may provide a system for widening a flow range of a compressor such as the prior art compressor 10. A desirable increasing of flow range may achieved by modifying the prior art compressor 10 of FIG. 1 into an inventive configuration illustrated in FIG. 2.

Figure 2:
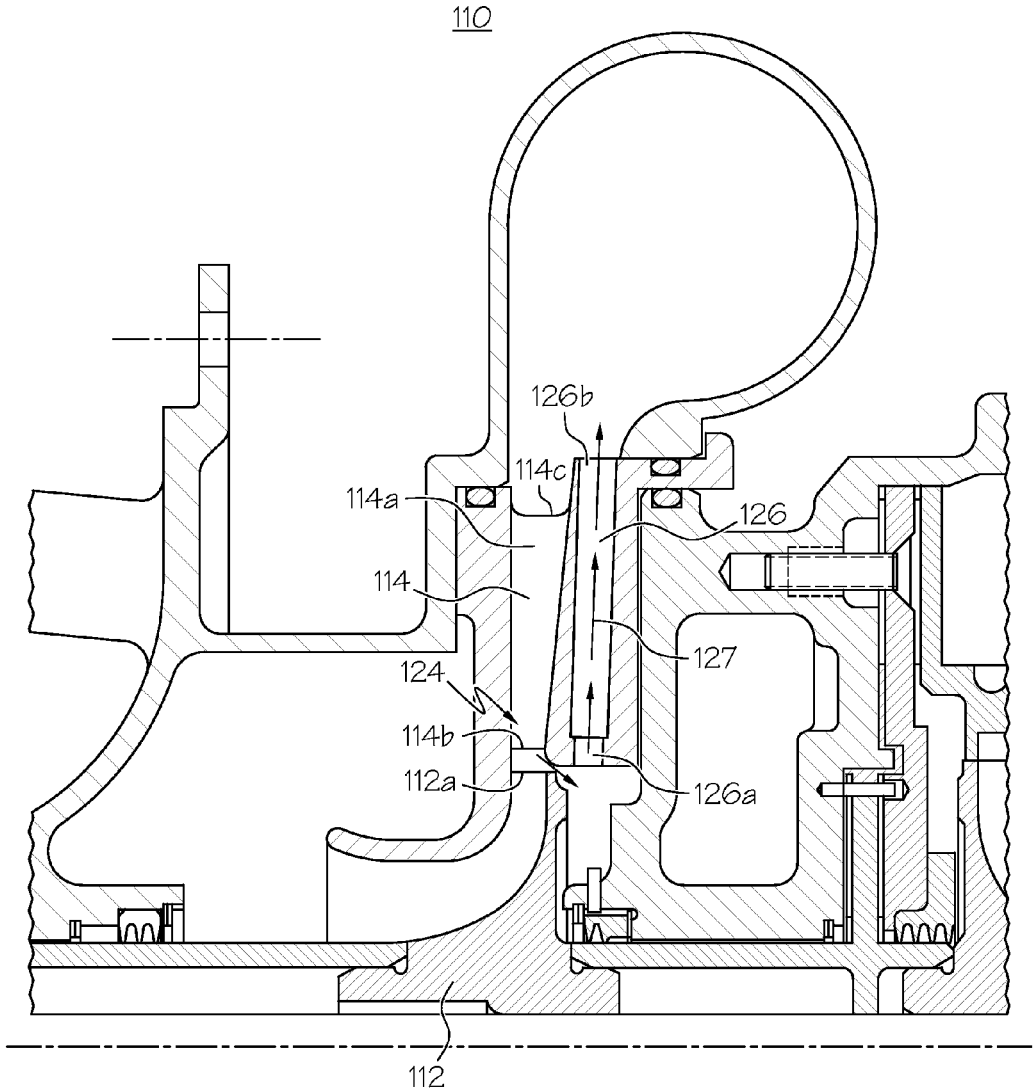
FIG. 2 is a partial cross sectional view of a portion of the compressor of FIG. 1 modified in accordance with the present invention.

Referring now to FIG. 2, a modified compressor 110 is shown with a gas flow bypass 126 that may interconnect a throat 124 and some point downstream from the throat 124. In a compressor such as the compressor 110, the throat 124 typically develops downstream from a trailing edge 112*a* of a wheel 112 and upstream from trailing edges 114*c* of vanes 114*a* of a diffuser 114.

In an exemplary embodiment of the bypass 126 of FIG. 2, a path for gas flow through the bypass 126 is indicated with arrows 127. The bypass 126 may have a bypass upstream inlet 126*a*, at or near a throat 124, and a bypass downstream inlet 126*b* downstream from the throat 124. In the particular embodiment illustrated in FIG. 2, the bypass downstream inlet 126*b* is located at a trailing edge 114*c* of the diffuser 114. But the bypass downstream inlet 126*b* may be at any position downstream from the throat 124.

Figure 3A:
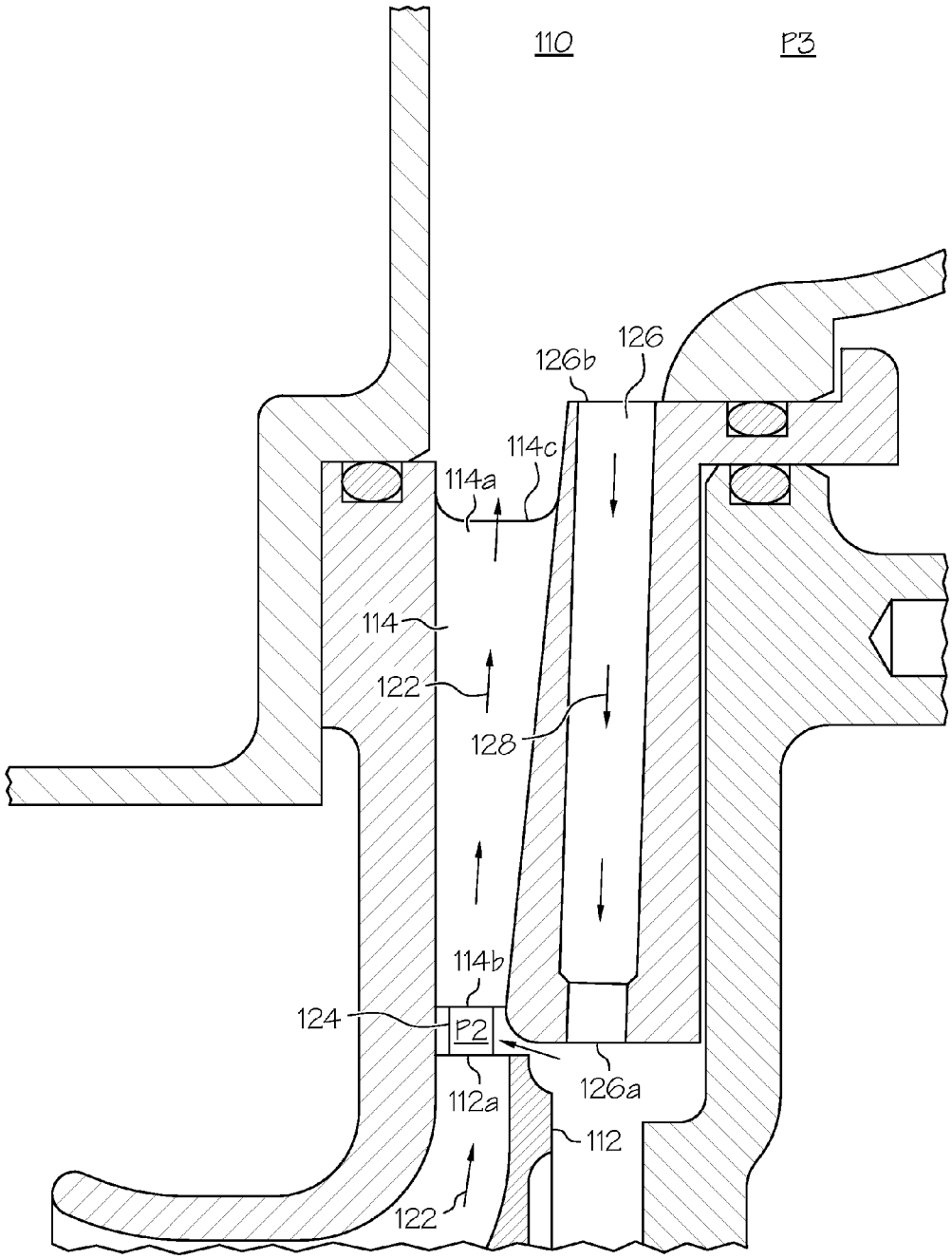
FIGS. 3*a*-3*d* are partial cross-sectional views of a portion of the modified compressor of FIG. 2 showing various operational features in accordance with the present invention.
Figure 3B:
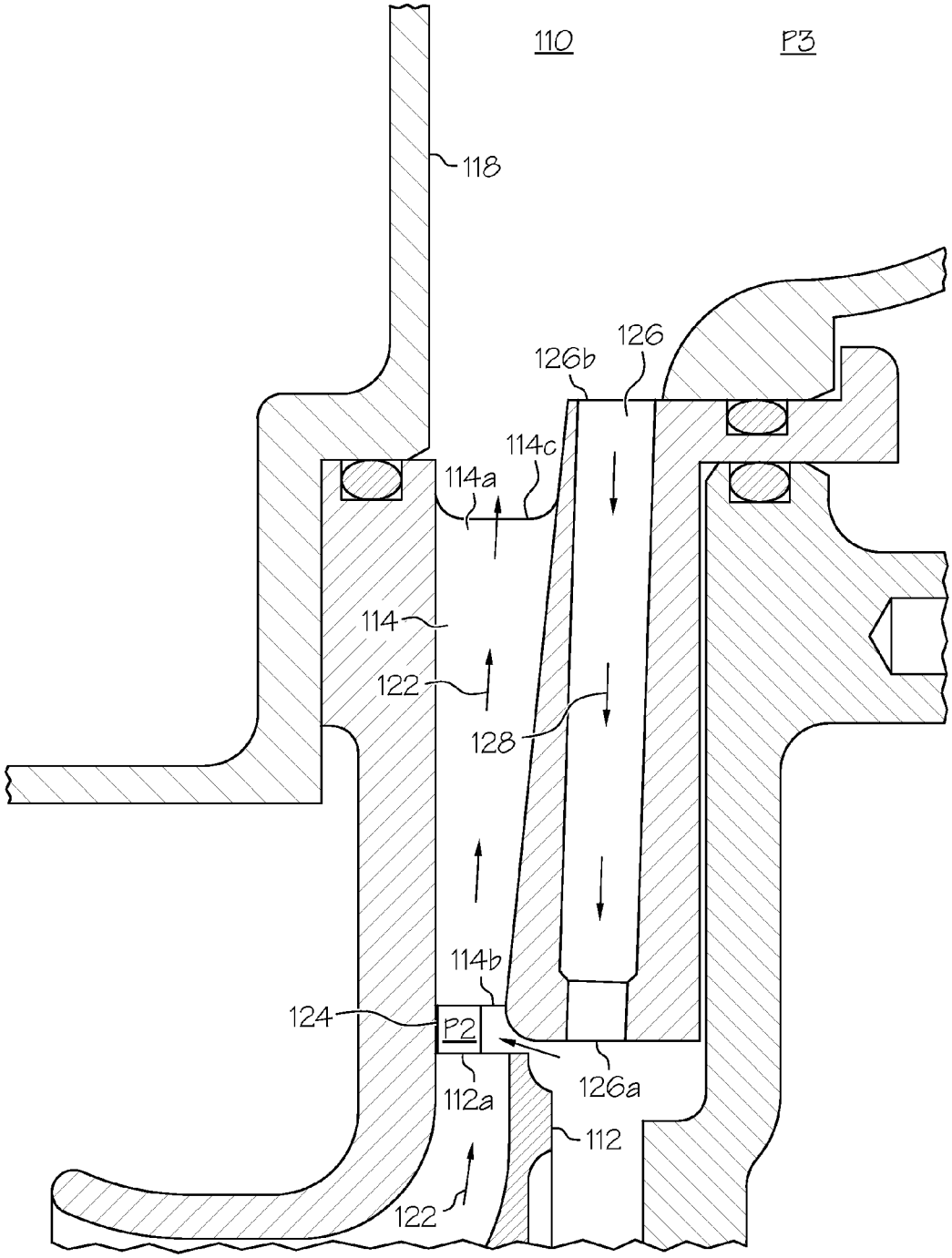
Figure 3C:
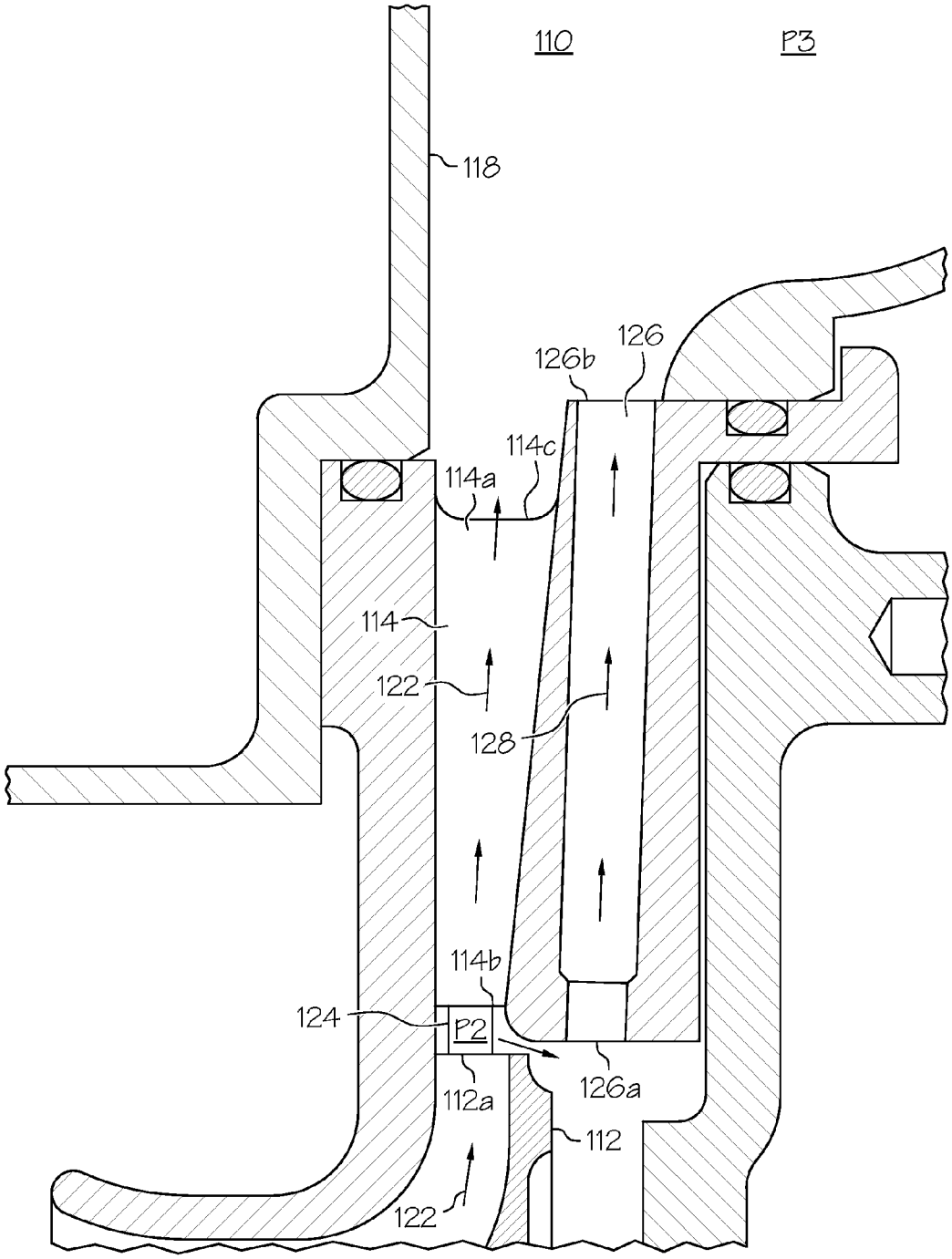

Operation of the bypass 126 may be understood by referring to FIG. 3*a*-3*c*.

In FIG. 3*a*, the compressor 110 is shown at mid flow-range or normal operation. In this normal operational state a gas pressure, P2, at the throat 124 may be lower than a gas pressure, P3, in a housing 118. Consequently, some gas may recycle through the bypass 126. This condition is represented by bypass flow lines 128 oriented in an upstream direction.

In FIG. 3*b*, the compressor 110 is shown in a state of "near surge" operation. In the "near surge" state, the pressure P3 may also be greater than the pressure P2. At "near surge" operation the differential between the pressures P2 and P3 may be greater than a corresponding pressure differential at normal operation. Consequently, recycled gas flow through the bypass 126 at "near surge" may be greater than a corresponding gas flow at normal operation. The recycled gas, represented by the bypass flow lines 128, may merge with the mainstream gas, represented by the mainstream flow lines 122. The merging of gas flows may provide added mass of gas to the mainstream. Because recycled gas may be added to the mainstream, the compressor 110 may be operated at a lower rotational speed without experiencing "surging". In other words, its flow range may be widened in a downward direction.

In FIG. 3*c*, the compressor 110 is shown in a state of "near choke" operation. In the "near choke" state, the pressure P2 may be greater than the pressure P3. As a result of this pressure differential, bypass gas flow, indicated by the bypass flowlines 128, may develop in a downstream direction. This "near choke" bypass flow may produce a reduced velocity of gas entering the throat. As a result, the compressor 110 may be operated at a higher flow rate before "choke" conditions develop. In other words, its range of stable operation at a given speed is widened.

As illustrated in FIGS. 3*a*-3*c*, the bypass 126 may allow gas to flow in either an upstream or a downstream direction. Consequently, the bypass 126 may be considered a bi-directional bypass In FIG. 3*d*, the compressor 110 is shown with a unidirectional valve 130 in a bypass 226. The valve 130 may be a conventional shuttle valve or a conventional check valve. The valve 130 may be oriented so that it blocks gas flow through the bypass 226 in an upstream direction. In this regard, the presence of the valve 130 may result in the bypass 226 being a unidirectional bypass. The unidirectional bypass 226 may be distinguished from the bypass 126 of FIGS. 3*a*-3*c*, which bypass 126 is bi-directional.

Figure 3D:
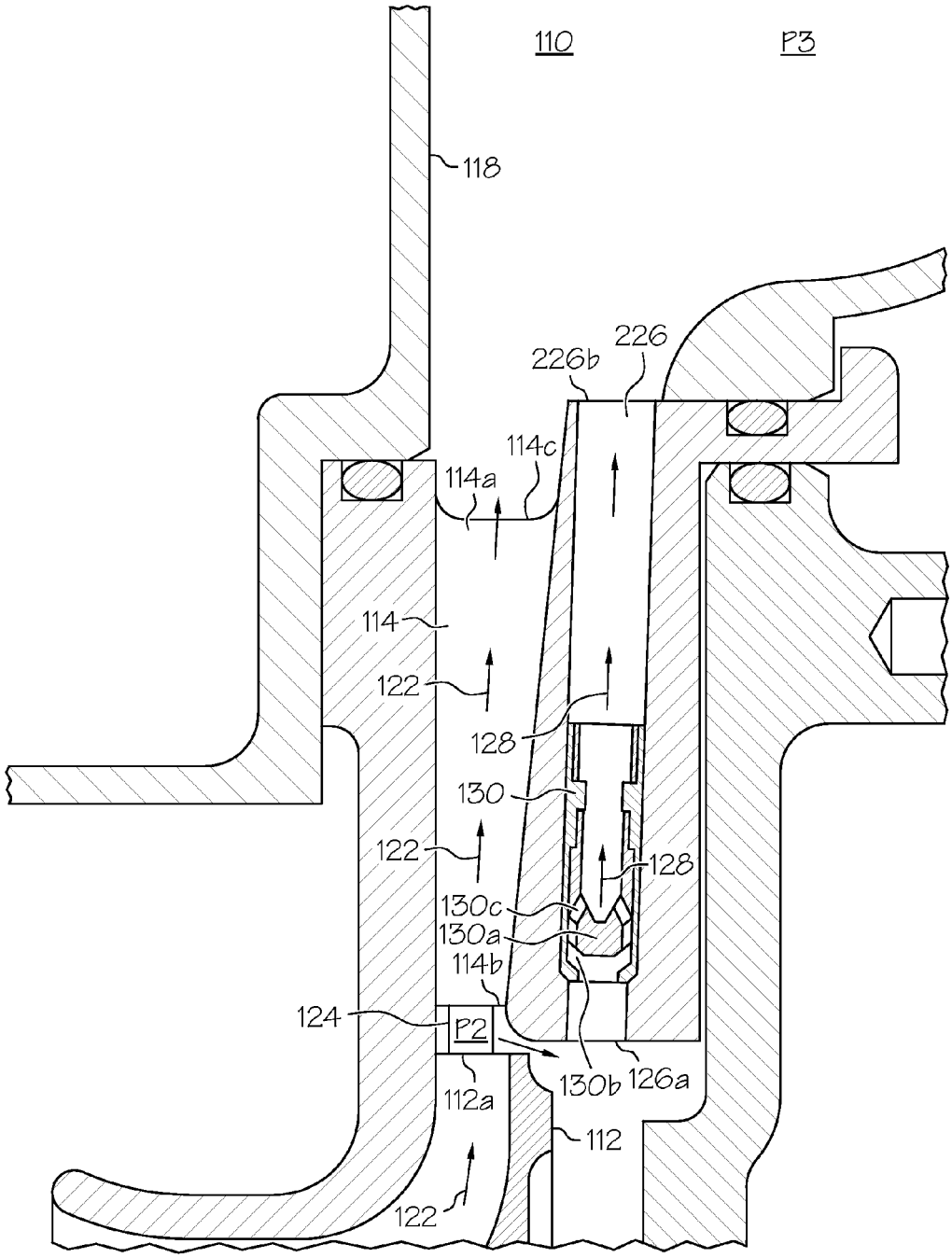

In FIG. 3*d*, the valve 130 is illustrated as a shuttle valve having a shuttle 130*a* and gas ports 130*c*. When pressure P2 exceeds pressure P3, the shuttle 130*a* may move away from its seat 130*b* and allow gas flow thru the gas ports 130*c* and thru the bypass 226 in a downstream direction.

When the compressor 110 is provided with the unidirectional bypass 226, the flow range of the compressor 110 may be widened towards the right side of a compressor map. However, the unidirectional bypass 226 may not widen the range of the compressor 110 towards the left side of a compressor map. As described above, bypass flow in a downstream direction may allow for increased flow before "choke" develops and bypass flow in an upstream direction may allow for decreased flow before "surge" develops. Even though the current unidirectional bypass 226 may allow only downstream bypass flow, it could be arranged to allow only upstream bypass flow by simply reversing the check valve or shuttle valve direction whenever achieving the surge margin improvement as well as maintaining normal operation efficiency becomes important.

There may be an advantage to the unidirectional bypass 226 as compared to the bi-directional bypass 126. This can be best understood by referring back to FIG. 3*a*, in which normal operation is illustrated. In normal operation or mid-flow range operation, gas flow through the bypass 126 in an upstream direction may produce diminished performance of the compressor 110. This is because gas which is recycled through the bypass 126 must be re-compressed. Re-compressing recycled gas consumes energy. Thus, one of the compressors 110 with one of the bi-directional bypasses 126 may not be as efficient as it would be with one of the unidirectional bypasses 226 of FIG. 3*d*.

It can be seen that a trade-off between efficiency and expanded range may be made. If flow range widening in both directions of a compressor map, i.e., improving both the surge and choke margins of a compressor is particularly valued, then an efficiency penalty associated with the bi-directional bypass 226 may be warranted. If efficiency at normal operating conditions is important then the unidirectional bypass 226 may be a desirable choice.

The present invention may provide a simple expedient for widening a flow range of the compressor 110 without a redesign of the compressor 110. In that regard the present invention may be considered an inventive method for modifying the compressor 110.

Figure 4:
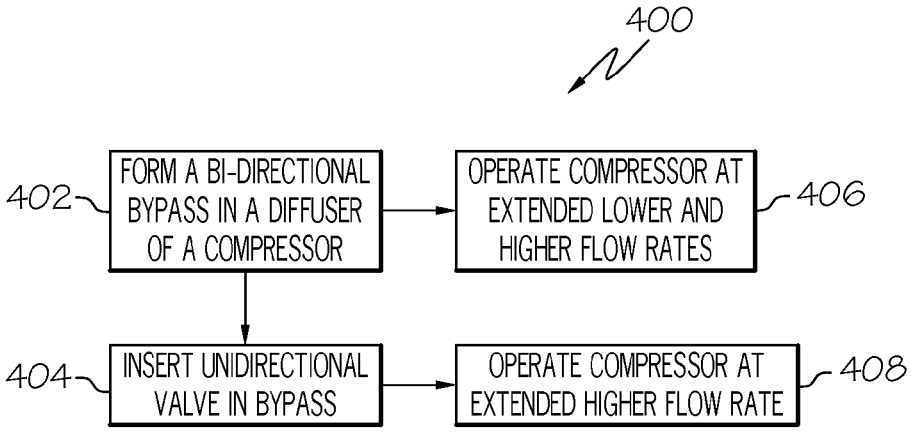
FIG. 4 is a flow chart of a method of widening a flow range of a compressor in accordance with the present invention.

FIG. 4 provides a flow chart that illustrates the steps of an inventive method 400 for widening a flow range of the compressor 110. In a step 402 the diffuser 114 of the compressor 110 may have a bypass 126 formed therein. In an additional optional step 404 a unidirectional valve 130 may be inserted into the bypass 126 to produce a unidirectional bypass 226. After completion of the step 402, the compressor 110 may be operated with widened lower and higher flow rates in a step 406. After the optional step 404, the compressor 110 may be operated with a widened higher flow rate in a step 408.

Figure 5:
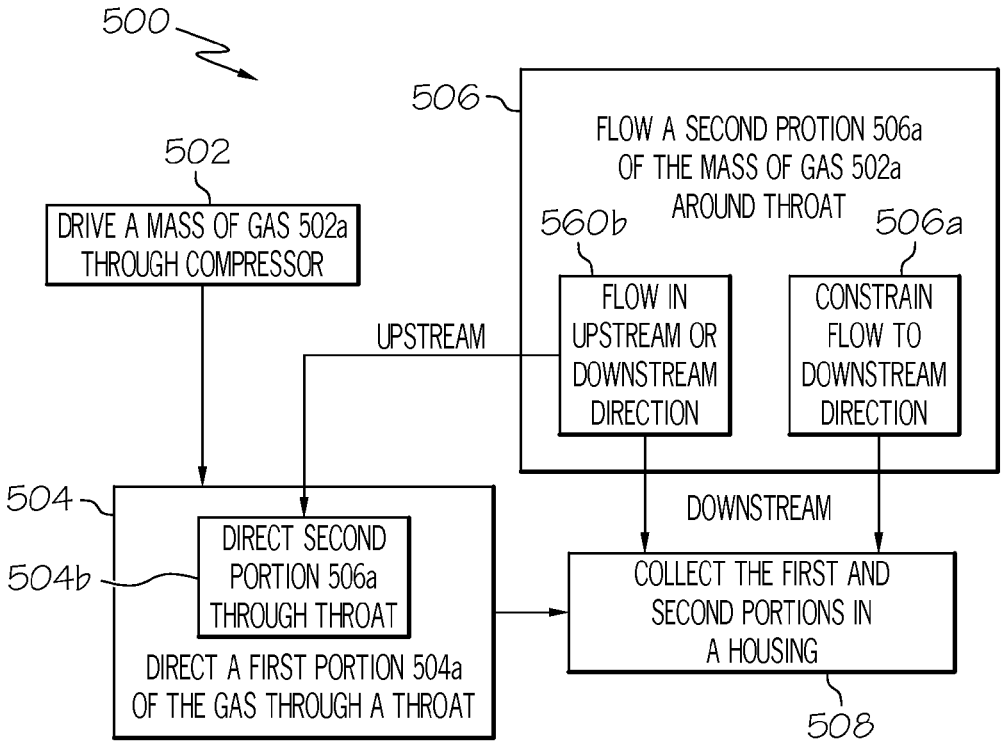
FIG. 5 is a flow chart of a method of compressing a gas in accordance with the present invention.

Additionally, the present invention may provide a method for compressing gas in the compressor 110 of FIG. 2 through a widened flow range. This inventive method, designated generally by the numeral 500, is illustrated in FIG. 5. In a step 502, a mass of gas 502*a* may be driven through the compressor 110 of FIG. 2 by the wheel 112. In a step 504 a first portion 504*a* of the mass of gas 502*a* may be directed through the throat 124 of the compressor 110. In a step 506 a second portion 506*a* of the mass of gas 502*a* may flow through a bypass around the throat 124.

The step 506 may be performed in two different modes. In a first mode, a step 506*b* may provide for directing gas flow in either an upstream or a downstream direction. In the case of upstream flow of the step 506*b*, the second portion 506*a* may emerge from the housing 118 of the compressor 110 as re-cycled gas flow. In a step 504*b*, this re-cycled gas flow may combine with the first portion 504*a* of the gas at the throat 124. Thus, a flow range of the compressor 110 may be widened downwardly. In the case of downstream flow of the step 506*b*, the second portion 506*a* may be drawn away from the throat 124 and, and in a step 508, may combine with the first portion 504*a* in the housing 118 of the compressor 110 of FIG. 2. Thus, the flow range of the compressor 110 may be widened.

In an alternate step 506*c*, flow of the second portion 506*a* may be constrained to a downstream direction. The constraining step 506*a* may be performed with, by way of example, the shuttle valve 130 of FIG. 3*c*. When the step 506*c* is employed, the flow range of the compressor 110 may be widened only towards the right side of a compressor map and the compressor 110 may not be required to recycle an upstream flow of the second portion 506*a*. In the step 508, the first portion 504*a* of the gas and the second portion 506*a* of the gas may be collected in the housing 118 of the compressor 110.

It should be understood, of course, that the foregoing relates to exemplary embodiments of the invention and that modifications may be made without departing from the spirit and scope of the invention as set forth in the following claims.

We claim:

1. A compressor, comprising:

a wheel;

a vaned diffuser; and a bypass wherein the bypass includes:

a first opening positioned downstream from a trailing edge of the wheel of the compressor; and a second opening positioned downstream from trailing edges of vanes of the diffuser; and a check valve that blocks gas flow through the bypass in a first direction while allowing gas flow through the bypass in second direction opposite to the first direction.

2. The compressor of claim 1 wherein the first opening of the bypass is positioned upstream from a leading edge of a vane of the diffuser.

3. The compressor of claim 1 wherein the check valve comprises a shuttle valve.

4. A method for compressing a widened flow range of gas with a compressor comprising the steps of:

driving a mass of the gas with a wheel;

directing a first portion of the mass of gas through a throat of the compressor, which throat is downstream from the wheel; and allowing flow of a second portion of the mass of gas through a bypass check valve in a first direction around the throat when gas pressure in the throat has a predetermined relationship to gas pressure at an output side of the compressor; and blocking flow of gas through the check valve when gas pressure in the throat does not have the predetermined relationship to gas pressure at the output side of the compressor.

5. The method of claim 4 wherein:

the gas pressure predetermined relationship comprises gas pressure in the throat being greater than gas pressure at the output side; and the step of allowing flow of the second portion comprises allowing gas flow in a downstream direction.

6. The method of claim 4 wherein:

the gas pressure predetermined relationship comprises gas pressure in the throat being less than gas pressure at the output side; and the step of allowing flow of the second portion comprises allowing gas flow in an upstream direction.

7. A compressor having a throat that is downstream from a trailing edge of a wheel comprising:

a bypass with an upstream inlet positioned at the throat and a downstream inlet positioned downstream of the throat;

a vaned diffuser wherein the bypass passes through the diffuser;

a check valve that blocks gas flow through the bypass in a first direction while allowing gas flow through the bypass in second direction opposite to the first direction.

8. The compressor of claim 7 wherein a valve is positioned in the bypass and said valve blocks upstream gas flow through the bypass.

9. The compressor of claim 7 which further comprises a unidirectional valve positioned in the diffuser.

* * * * *